US010032573B2

(12) United States Patent
Freyermuth et al.

(10) Patent No.: US 10,032,573 B2
(45) Date of Patent: Jul. 24, 2018

(54) OPERATING OR COMMAND ELEMENT, IN PARTICULAR FOR THE FIELD OF HYGIENE

(71) Applicant: Eaton Electrical IP GmbH & Co. KG, Schoenefeld (DE)

(72) Inventors: Thomas Freyermuth, Kalenborn (DE); Deepak Sanan, Bonn (DE); Mathias Borneck, Bonn (DE)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 15/324,274

(22) PCT Filed: Jun. 22, 2015

(86) PCT No.: PCT/EP2015/063983
§ 371 (c)(1),
(2) Date: Jan. 6, 2017

(87) PCT Pub. No.: WO2016/005177
PCT Pub. Date: Jan. 14, 2016

(65) Prior Publication Data

US 2017/0178835 A1 Jun. 22, 2017

(30) Foreign Application Priority Data

Jul. 9, 2014 (DE) ..... 10 2014 109 640

(51) Int. Cl.
*H01H 13/14* (2006.01)

(52) U.S. Cl.
CPC ..... *H01H 13/14* (2013.01)

(58) Field of Classification Search
CPC ..... H01H 13/14; H01H 3/022; H01H 13/06; H01H 19/06; H01H 3/0206
USPC ..... 200/341, 345
See application file for complete search history.

(56) References Cited

U.S. PATENT DOCUMENTS 2,984,726 A * 5/1961 Roeser ..... H01H 13/063 200/296
3,937,913 A 2/1976 Soulas et al.
4,066,851 A * 1/1978 White ..... H01H 1/403 200/292
5,584,381 A * 12/1996 Brundage ..... H01H 23/025 200/313

(Continued)

FOREIGN PATENT DOCUMENTS

CN 102782788 A 11/2012
DE 2361639 A1 6/1974

(Continued)

*Primary Examiner* — Edwin A. Leon
(74) *Attorney, Agent, or Firm* — Leydig, Voit & Mayer, Ltd.

(57) ABSTRACT

An operating or command element has a key plate having a substantially flat or slightly curved basic form and having a plurality of surface elevations, which are formed on the basic form and which can be tactilely sensed using a fingertip so that the position of the fingertip on the key plate can be sensed. Both in a horizontal and in a vertical installation position of the operating or command element, the key plate can be free of recesses in which liquids can accumulate. Other installation angles are also possible, for example in the case of installation in an inclined console housing.

11 Claims, 3 Drawing Sheets

(56) References Cited

U.S. PATENT DOCUMENTS

| | | | | |
|---|---|---|---|---|
| 7,642,476 | B2 * | 1/2010 | Virtanen | H01H 13/06 200/302.1 |
| 2012/0325637 | A1 | 12/2012 | Kikuchi | |

FOREIGN PATENT DOCUMENTS

| | | | |
|---|---|---|---|
| DE | 3923747 | A1 | 1/1991 |
| DE | 19954172 | A1 | 5/2001 |
| DE | 102006055249 | A1 | 5/2008 |

* cited by examiner

OPERATING OR COMMAND ELEMENT, IN PARTICULAR FOR THE FIELD OF HYGIENE

CROSS-REFERENCE TO RELATED APPLICATIONS

This application is a U.S. national stage application under 35 U.S.C. § 371 of International Application No. PCT/EP2015/063983, filed on Jun. 22, 2015, and claims benefit to German Patent Application No. DE 10 2014 109 640.1, filed on Jul. 9, 2014. The International Application was published in German on Jan. 14, 2016, as WO 2016/005177 A1 under PCT Article 21(2).

FIELD

The invention relates to an operating or command element, comprising a key plate having a substantially flat or slightly curved basic form.

BACKGROUND

An operating or command element in the form of a push button which has a level key plate is known from prior art. The round key plate has a circumferential ring as a surface elevation on the edge of the key plate so that when the push button is arranged horizontally or lying down, a flat depression is formed on the key plate.

On a reverse side, the push button has a level contact surface, which is parallel to the front side of the key plate and in the installation position of the push button abuts against a front plate of a housing, control cabinet, or the like and, therefore, determines the position of the push button. Usually, a part of the push button reaches through an opening in the wall of the housing. The part located outside the housing, i.e., the key plate with the circumferential ring, can become more or less heavily soiled depending upon the area of application. If the push button is used in the field of hygiene it must, as a rule, be cleaned regularly with a liquid cleaning agent.

If, however, the push button is used in a horizontal installation position, the liquid cleaning agent accumulates in the depression and cannot flow off. This is unacceptable, and not just for hygiene reasons, thereby excluding the use of the push button for such installation positions.

Furthermore, a push button is known from the prior art whose key plate, which is also round, is completely level. With such a push button, no liquid cleaning agent accumulates during the cleaning of the push button. Disadvantageous, however, is the fact that detection of a completely level push button is practically impossible. Therefore, an operator cannot detect such a push button blindly (that is, by feeling with his fingertip), as would, however, be possible with the previously described push button with the circumferential ring.

DE 10 2006 055 249 shows an operating element with a key plate on which nubs are arranged for the purpose of improving the grip. DE 39 23 747 A1 discloses an actuator for electrical switchgears, wherein a push button is designed in the form of a quadratic plate on which the nubs projecting upwards represent individual characters in braille. DE 2 361 639 discloses a push button for outdoor facilities which is supposed to be less susceptible to blockages caused by ice. All of these operating elements, however, have in common that they cannot be put to use universally in the field of hygiene.

SUMMARY

An aspect of the invention provides an operating or command element, comprising: a key plate having a substantially flat or a slightly curved basic form, the key plate including several surface elevations, the surface elevations being formed on a basic form and being tactilely detectable using a fingertip so that a fingertip position on the key plate can be sensed and thus centered, wherein both in a horizontal and in a vertical installed position of the operating or command element, the key plate is free of recesses in which liquids can accumulate, wherein a contact surface is provided configured to determine a position of the operating or command element on a wall or front plate of a housing, wherein the key plate includes an edge, which, in an installed position of the operating or command element, abuts against a front plate of the housing without gaps or predominantly without gaps, wherein the key plate includes angle to the wall at a contact point of at least 93 degrees, wherein the edge, and includes a sealing element which is flush with an outer surface of the edge, wherein a restrictor is provided configured to restrict compression of the sealing element in an installed position of the operating and command element.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
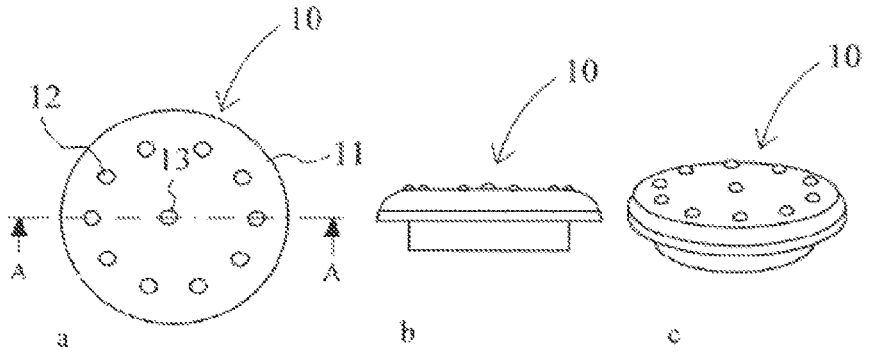
FIG. 1 a first exemplary embodiment for an operating element, in different views.

An aspect of the invention provides an operating or command element that allows blind position recognition and that may be universally used in the field of hygiene.

According to an aspect of the invention, several (at least two) surface elevations are provided on the key plate, wherein, both in a horizontal and in a vertical installation position of the operating or command element, the key plate is free of recesses in which liquids (for example, cleaning fluids) may accumulate. This ensures that liquids can flow off the key plate, regardless of the horizontal or vertical installation position. The surface of the key plate, which is formed from a substantially flat or slightly curved basic form and the surface elevations arranged thereon, forms a three-dimensional free-form surface. With this surface and the elevations present thereon, all curvatures are formed such that an incline always occurs that allows liquid to flow off freely. When, for example, the operating or command element (hereinafter abbreviated as operating element) is in a horizontal installation position, the key plate may, therefore, have several valleys, which are, however, always saddle-shaped or formed such that they slope in an arbitrary horizontal direction or do not form a local minimum in this direction. In other words, the key plate has only surface sections from which liquids can flow off to an adjacent surface section, whereby there is no restriction on the installation position. If the surface section is a surface section at the edge, it must be ensured that liquids can either flow off from this surface section to an adjacent surface section or can leave the carrier plate completely.

The operating element comprises a contact surface which serves to determine the position of the operating element on a wall or a front plate of a housing. This position determination also determines the incline which the key plate of the operating element has to the wall of the housing. Preferably, the contact surface is essentially parallel to the front plate.

According to an aspect of the invention, the key plate has an edge which, in the installation position, abuts against the wall or front plate of the housing without gaps or predominantly without gaps and has an angle to the wall at the contact point of at least 93 degrees (for example, 93 to 95 degrees, 93 to 110 degrees, or 95 to 120 degrees).

The edge comprises a sealing element, wherein, in a preferred exemplary embodiment, means 31 are provided which restrict the compression of the sealing element in the installation position. This ensures that the sealing element is loaded only within its elasticity limits and does not lose its sealing effect. Without this limitation, it would otherwise be possible to, for example, crush the sealing element; likewise, temperature changes could also cause an overload of the material, which would lead to a decrease in the sealing performance. The potential compression of the sealing element can be 5 to 20 percent (in relation to the non-deformed state). According to the invention, the sealing element attaches to the external form of the edge without offset or discontinuity.

In an exemplary embodiment of the invention, the basic form is curved convexly. It can, however, also be level, or provided with indentations. However, it should be ensured that these indentations do not form any depressions out of which liquids are unable to flow off.

The at least one surface elevation may be a section of a sphere with a diameter D, wherein a height of the section in relation to the basic form is smaller than D/2. In a borderline case, therefore, the surface elevation constitutes a hemisphere. If the diameter D of the sphere is, for example, 2.5 millimeters, the height of the sphere in relation to the basic form may preferably be 0.8 to 1.2 millimeters.

The shape of the surface elevation is not just restricted to the spherical shape. Other shapes or structures many also be used for the surface elevation. An exemplary embodiment concerns an asymmetrical surface elevation with an external face and an internal face, wherein the external face progresses more steeply than the internal face, and the internal face faces a middle point of the key plate. With a key plate which is round in plan view, the middle point corresponds to the middle point of the circular key plate.

The key plate may have a first group of surface elevations, wherein the surface elevations of the first group lie in a circle. The surface elevations may also be arranged around the middle point of the key plate in a different constellation (for example, in an oval or in a polygon). If, for example, the key plate in the plan view is rectangular, the surface elevations of the first group could be designed in a rectangle which is arranged around the point of intersection of the diagonals of the rectangular key plate.

The number of surface elevations of the first group is preferably uneven (for example, 3, 5, 7, 9, etc.). If, for example, the surface elevations of the first group are arranged in a circle, and if the operating element is in a vertical installation position, liquid which drips from a top surface elevation (which, taking a clock face as a basis, would correspond to 12 o'clock) then very likely encounters a passage (in the proximity of 6 o'clock) between two bottom surface elevations. Liquid can, therefore, simply flow off. With an even number, a bottom surface elevation would be arranged exactly below the top surface elevation, which bottom surface elevation would then prevent free flow-off.

In an exemplary embodiment, the key plate has a second group of surface elevations which are arranged in a middle area of the key plate. The size, shape, and arrangement of these surface elevations with respect to each other may be oriented to the specifications of braille for the blind and visually impaired. In this case, it is known that dot structures can be identified by the fingertip. For example, the surface elevations may essentially be hemispherical dots which protrude 0.6 to 0.7 millimeters from the basic form. A distance from midpoint to midpoint of a dot may be 2.5 to 3 millimeters. The arrangement of the dots enables pictograms or even individual letters in braille to be reproduced.

In one exemplary embodiment, an angle between the basic form and the surface elevation is always greater than 90 degrees. If, for example, the surface elevation is an exact hemisphere, the angle between the basic form and this hemisphere would be 90 degrees. However, if it is a sphere segment, the height of which in relation to the basic form is smaller than D/2, the angle between the basic form and surface elevation is greater than 90 degrees.

A transition radius between a surface section of the carrier plate and an adjacent surface section may always be greater than 3 millimeters. In this way, sharp edges or corners are avoided in which dirt, bacteria, or the like could accumulate. This also makes it easier to carry out a complete cleaning of the operating element.

Each surface section of the carrier plate may be inclined by at least 3 degrees to the horizontal. This angle of inclination results in liquids being able to reliably flow off from every surface section of the carrier plate with a horizontal and vertical installation position. The surface roughness of the surface of the carrier plate is preferably minimal. In one exemplary embodiment, it is in the arithmetic mean below 0.8 μm ($R_a \leq 0.8$ μm).

Figure 2:
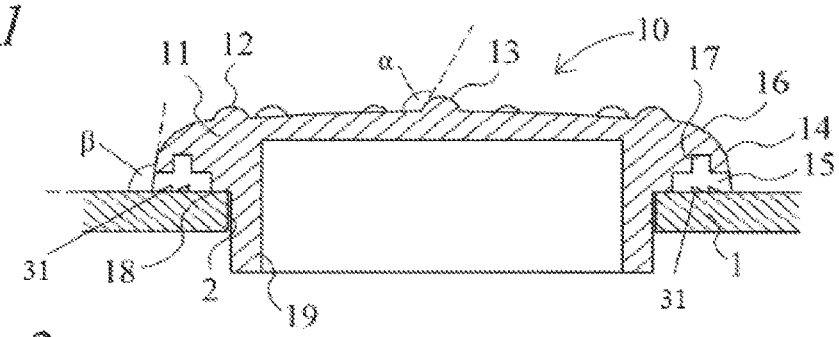
FIG. 2 a sectional view of the operating element of FIG. 1 with horizontal installation position.

FIG. 1 shows a first exemplary embodiment for an operating element identified as 10, in different views. FIG. 1*a* shows the operating element in plan view, FIG. 1*b* in side view, and FIG. 1*c* in perspectival view. FIG. 2 shows a sectional view of the operating element 10 of FIG. 1, wherein, additionally, here a front plate 1 of a housing, which is not represented further here, is represented.

The operating element 10 comprises a round carrier plate 11 which has a slightly curved basic form. Several surface elevations 12 are arranged in a circle on this basic form, which surface elevations should belong to a first group of surface elevations. This comprises ten dots which are spaced evenly from one another in circumferential direction of the circle. These dots have a centering effect on the fingertips of an operator. A further surface elevation 13 is provided which is concentric to the circle on which the surface elevations 12 are located. This surface elevation 13 is in the midpoint of the circular carrier plate 11. It is used for an additional position identification which can be felt with the fingertips.

As can be seen in particular in FIG. 2, which shows the operating element 10 in the sectional view AA of FIG. 1*a*, the surface elevations 12, 13 are formed approximately as semicircular dots. An angle α between the middle surface elevations 13 and the basic form of the carrier plate 11 is approximately 115 degrees in the exemplary embodiment in FIGS. 1 and 2. There is also an approximately equally large angle between the basic form and the other surface elevations.

The carrier plate 11 comprises an edge 14 which has a sealing element 15. The edge 14, with the sealing element 15 which is flush with an outer surface of the edge, forms an angle β to the front plate 1 which is at least 93 degrees, e.g., approximately 100 degrees. In a rounded transition area 16, the essentially level basic form turns into the edge 14. The sealing element 15 is held securely in position by a holding groove 17 of the edge 14. An annular arrangement 18 of the operating element 10 determines the position of the operating element 10 in relation to the wall 1. In addition, the contact surface 18 ensures that the sealing element 15 can be compressed only to a certain degree in the installation position represented here. A shaft 19 of the operating element 10 reaches through a hole 2 in the front plate 1.

The operating element 10 is designed such that liquids cannot accumulate anywhere in a horizontal or vertical installation position (compare FIG. 2 and). Therefore, the operating element 10 can readily be used in the field of hygiene, in which cleaning with liquid cleaning agents is common practice. The selection of angles α, β also ensures that no undercuts or sharp corners are formed in which dirt and bacteria can accumulate or from which dirt and bacteria may only be removed with a great deal of effort, if at all.

A diameter of the carrier plate should be 25 to 35 millimeters from edge to edge. This corresponds to today's standard operating elements, where this size has proven itself. Accordingly, the diameter of the circle on which the surface elevations 12 are located is approximately 20 to 25 mm. Therefore, several surface elevations 12, 13 may be felt simultaneously by a fingertip of an operator of the operating element 10, and centering the fingertip on the operating element is thus only possible by touch. Therefore, by means of the arrangement of the surface elevations 12 in the circle and the surface elevation 13 in the middle of the key plate 11, the operator may exactly determine the position of his finger in relation to the key plate 11, without thereby having to see the key plate 11.

Figure 3:
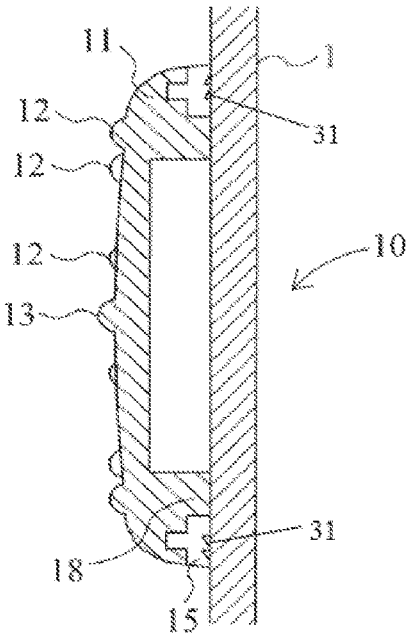
FIG. 3 a sectional view of a second exemplary embodiment for the operating element with a vertical installation position.

FIG. 3 shows a sectional view of a second exemplary embodiment for the operating element, which is also identified as 10, with a vertical installation position; Characteristics or components that are similar or identical to characteristics or components of the exemplary embodiment of FIGS. 1 and 2 are provided with the same reference signs. This also applies analogously to all other figures.

In contrast to the exemplary embodiment of FIGS. 1 and 2, the operating element 10 in FIG. 3 does not have a shaft 19 which reaches through a hole in wall 1. The part that reaches through the front plate 1 is simply not illustrated; however, it is also possible for an operating element to be constructed such that it need only be affixed to the front plate 1.

Figure 4:
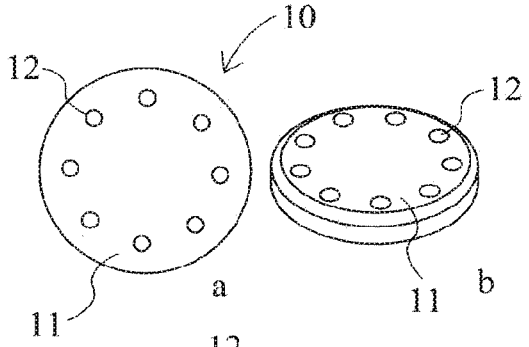
FIGS. 4-6 other exemplary embodiments in different views.
Figure 5:
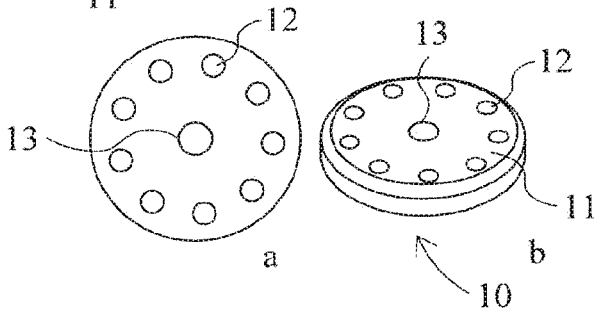
Figure 6:
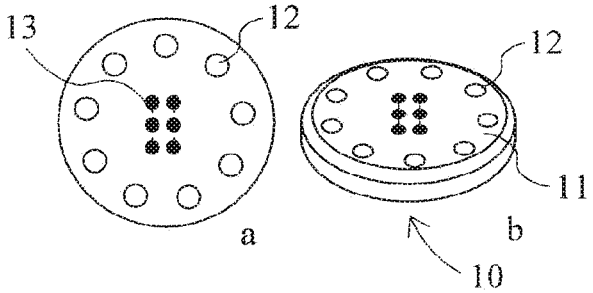
Figure 7:
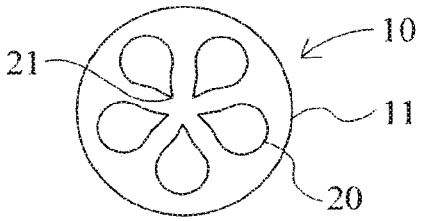
FIG. 7-13 other exemplary embodiments in plan view.
Figure 8:
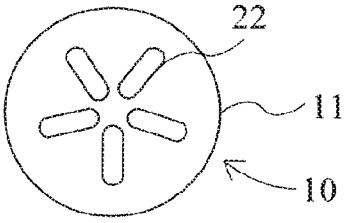

FIGS. 4 through 6 show other exemplary embodiments in different views. The surface elevations 12, 13 represented there are shown in a simplified form as circular dots. The exemplary embodiment in FIG. 4 has eight surface elevations 12 arranged in a circle. In contrast to the exemplary embodiment in FIGS. 1 and 2, no middle surface elevation is provided for. In the exemplary embodiment in FIG. 5, however, a middle surface elevation 13 is provided for. There is a total of nine surface elevations 12 arranged in a circle in this case. In the exemplary embodiment in FIG. 6, six surface elevations 13 are arranged in a rectangle 2×3 in the middle area of the key plate 11. The size, shape, and distance of these surface elevations 13 from each other are oriented to the requirements of braille for the blind and visually impaired.

Figure 9:
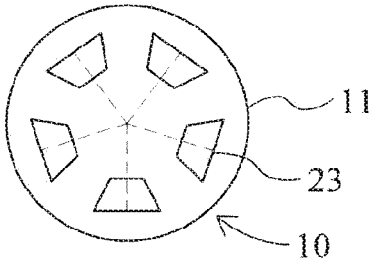

FIGS. 7 through 13 show further exemplary embodiments for the operating element 10, each in plan view. In contrast to the exemplary embodiments in FIGS. 1 through 6, these concern surface elevations which differ from a dot shape or from a hemispherical shape. The operating element 10 in FIG. 7 has five drop-shaped surface elevations 20, wherein a tip 21 of the surface elevation 20 points to the midpoint of the key plate 11. In the exemplary embodiment in FIG. 8, five surface elevations 22 are also provided, which are arranged in a circle coaxially to the midpoint of the carrier plate 11 and are in the shape of a rectangle with rounded corners or the shape of an elongated hole. The surface elevations identified as 23 in FIG. 9 are formed as a trapezoidal shape in the plan view. They too are arranged in a circle symmetrically with respect to the midpoint of the carrier plate.

Figure 10:
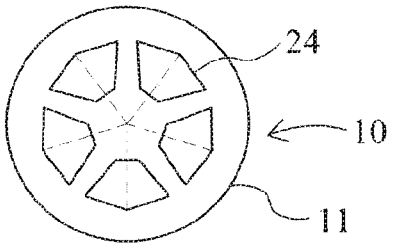
Figure 11:
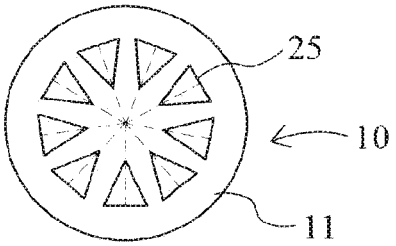
Figure 12:
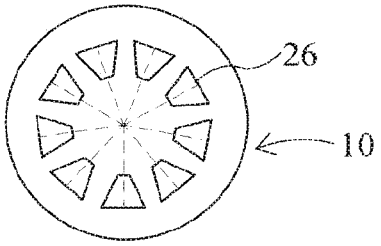

FIGS. 10 through 12 show other possible shapes for the surface elevations. In the exemplary embodiment in FIG. 10, the plan view shows pentagons 24. The surface elevations 25, 26 in FIGS. 11 and 12 are triangles in the plan view, wherein, in the exemplary embodiment in FIG. 12, the triangles have rounded corners. The height of the surface elevations levels off, becoming flatter towards the middle of the key plate. This means that the operator feels a recess with his fingertip.

Figure 13:
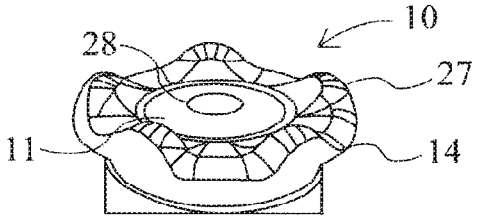
Figure 14:
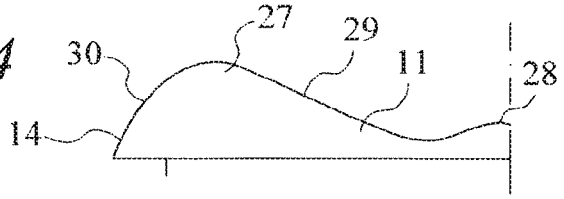
FIG. 14 a sectional view of a part of a carrier plate of FIG. 13.

FIG. 13 shows an exemplary embodiment for the operating element 10 that has five surface elevations 27 arranged around the circumference in the proximity of the edge 14 of the carrier plate 11. A circular surface elevation 28 is arranged centrally on the carrier plate 11. FIG. 14 shows a schematic sectional view of the progression of the surface of the carrier plate 11 from the edge 14 to the surface elevation 28 arranged in the middle of the carrier plate 11. The surface elevation 27 has an external face 30 originating from the edge 14, the incline of said external face being greater than the incline of an internal face 29 which faces the middle surface elevation 28. The internal face 29 tapers off slowly into the basic form of the carrier plate 11.

The five surface elevations 27 of the operating element 10 in FIGS. 13 and 14 form a trough shape which can easily be felt by means of the tip of a thumb or a different finger. It is also big enough to permit gloved operation. In the middle of this trough, a surface elevation 28 is then formed which can also easily be felt by means of the fingertip. The spacing of adjacent surface elevations 27, 28 is around 10 millimeters, so that the fingertip can feel two or more surface elevations simultaneously. This facilitates a reliable orientation of the fingertip on the carrier plate 11. Because the surface elevations 27 are at a distance from one another, liquid, which during cleaning of the operating element 10 could accumulate on the carrier plate 11 with a horizontal and vertical installation position, can run off between them. Other installation angles are also possible, e.g., in the case of installation in an inclined console housing.

The slightly curved surface, the form continuing in one line (without offset, and without interruption by gaps) over the sealing element to the wall (front plate), the radii used, the dimensions of the dots (elevations), and, not least, the round shape of the operating element allow liquids occurring in conjunction to always run off.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

LIST OF REFERENCE NUMBERS

1 Front plate
2 Hole
10 Operating or command element (operating element)
11 Key plate
12 Surface elevation
13 Surface elevation
14 Edge
15 Sealing element
16 Transition area
17 Holding groove
18 Contact surface
19 Shaft
20 Surface elevation
21 Tip
22 Surface elevation
21 Surface elevation
24 Surface elevation
25 Surface elevation
26 Surface elevation
27 Surface elevation
28 Surface elevation
29 Internal face
30 External face
31 Means for restricting the compression of the sealing element in the installation position

The invention claimed is:

1. An operating or command element, comprising:

a key plate having a substantially flat or a slightly curved basic form, the key plate including several surface elevations, the surface elevations being formed on the basic form and being tactilely detectable using a fingertip so that a fingertip position on the key plate can be sensed and thus centered, wherein both in a horizontal and in a vertical installed position of the operating or command element, the key plate is free of recesses in which liquids can accumulate, wherein a contact surface is provided configured to determine a position of the operating or command element on a wall or front plate of a housing, wherein the key plate includes an edge, which, in an installed position of the operating or command element, abuts against the front plate of the housing without gaps or predominantly without gaps, wherein the key plate includes angle to the wall at a contact point of at least 93 degrees, wherein the edge includes a sealing element which is flush with an outer surface of the edge, wherein a restrictor is provided configured to restrict compression of the sealing element in an installed position of the operating or command element, wherein the key plate includes a first group of the surface elevations, and wherein the surface elevations of the first group lie in a circle.

2. The operating or command element of claim 1, wherein the basic form is curved convexly.

3. The operating or command element of claim 1, wherein at least one of the surface elevations is a section of a sphere with a diameter, and wherein a height of the surface elevation in relation to the basic form is smaller than half of the diameter.

4. The operating or command element of claim 1, wherein at least one of the surface elevations includes an external face and an internal face, and wherein the external face progresses more steeply than the internal face.

5. The operating or command element of claim 1, wherein a number of surface elevations of the first group is uneven.

6. The operating or command element of claim 1, wherein the key plate includes a second group of the surface elevations arranged in a middle area of the key plate.

7. The operating or command element of claim 1, wherein an angle between the basic form and at least one of the surface elevations is at least 93 degrees.

8. The operating or command element of claim 1, wherein a transition radius between a surface section of the key plate and an adjacent surface section is always greater than 3 mm.

9. The operating or command element of claim 1, wherein each surface section of the key plate is inclined towards the contact surface by at least 3 degrees.

10. The operating or command element of claim 1, wherein the sealing element is held securely in position by a holding groove.

11. The operating or command element of claim 1, wherein the sealing element compression is 5 to 20% in relation to a non-deformed state thereof.

* * * * *